US009626941B1

(12) United States Patent
Moore et al.

(10) Patent No.: US 9,626,941 B1
(45) Date of Patent: Apr. 18, 2017

(54) ORGANIC TEXTURE ENHANCEMENT SYSTEM WITH DAMPERS FOR ACOUSTIC GUITARS AND OTHER STRINGED INSTRUMENTS

(71) Applicants: Dwaine Moore, Arnold, PA (US); Joseph S. DeSimone, Arnold, PA (US); Ralph A. DeSimone, Arnold, PA (US)

(72) Inventors: Dwaine Moore, Arnold, PA (US); Joseph S. DeSimone, Arnold, PA (US); Ralph A. DeSimone, Arnold, PA (US)

( * ) Notice: Subject to any disclaimer, the term of this patent is extended or adjusted under 35 U.S.C. 154(b) by 0 days.

(21) Appl. No.: 15/279,339

(22) Filed: Sep. 28, 2016

Related U.S. Application Data

(60) Provisional application No. 62/233,971, filed on Sep. 28, 2015.

(51) Int. Cl.
*G10D 3/02* (2006.01)
*G10D 1/08* (2006.01)

(52) U.S. Cl.
CPC ..... *G10D 3/02* (2013.01); *G10D 1/08* (2013.01)

(58) Field of Classification Search
CPC ..... G10D 3/02; G10D 1/08
See application file for complete search history.

(56) References Cited

U.S. PATENT DOCUMENTS

| | | | | |
|---|---|---|---|---|
| 685,920 | A * | 11/1901 | Heck | G10D 3/02 84/294 |
| 5,567,895 | A * | 10/1996 | Aspri | G10K 15/08 84/294 |
| 9,349,354 | B1 * | 5/2016 | Galloup | G10D 1/08 |
| 9,570,051 | B1 * | 2/2017 | Moore | G10D 3/02 |
| 2010/0083806 | A1 * | 4/2010 | Peavey | G10D 3/02 84/294 |
| 2010/0139473 | A1 * | 6/2010 | Umeda | G10D 3/02 84/294 |

* cited by examiner

*Primary Examiner* — Robert W Horn
(74) *Attorney, Agent, or Firm* — Gary P. Topolosky

(57) ABSTRACT

A sound resonator device for internal connection to a guitar or other musical instrument that has strings tensioned over a bridge piece. One embodiment of resonator includes a plurality of wound coils made of a harmonically predetermined (consistent or varying) thickness or gauge of metal wire secured to the instrument interior. A series of dampering devices are added for muting the effect of such sound resonation when desired. The dampering devices are activated using either a slider button (for felt dampers) or a rotating knob (for fiber threads).

17 Claims, 3 Drawing Sheets

ORGANIC TEXTURE ENHANCEMENT SYSTEM WITH DAMPERS FOR ACOUSTIC GUITARS AND OTHER STRINGED INSTRUMENTS

CROSS-REFERENCE TO RELATED APPLICATION

This is a perfection of Provisional Application Ser. No. 62/233,971, filed on Sep. 28, 2015, the disclosure of which is fully incorporated by reference herein.

FIELD OF THE INVENTION

The present invention relates to acoustic guitars and other stringed instruments. More particularly, it relates to a sound resonator device conveniently secured in the interior of such instruments for enhancing the textural sounds achievable while playing that instrument. It may be assembled into the manufacture of new musical/audio products or carefully inserted into the retrofit/repair of existing guitars and other stringed instruments.

The particular focus of this invention is the ability to dampen the effects of such textural sounds through the addition of a purposeful damper, either as a rotatable knob or as an actuator button. For certain applications/songs, it may be desired to revert to the original sounds from that instrument. So an incremental damping button is included for softening or "muting" the effects of this resonator device as that device rests in constant tension in a coiled and layered configuration.

The sound resonator device uses a uniquely designed waveform that is purposed to pull IN on itself, in an accordion-like fashion. The device attaches through a torsion arm mechanical interface that allows it to connect to any given plurality of the instrument's strings. Installation of this device also greatly reduces fatigue and warping of the soundboard while nullifying a sizeable percentage of the high torque stresses that strings normally impart to the bridge regions of such instruments.

BACKGROUND OF THE INVENTION

To enhance the tonality of the sound box of a musical instrument, one may incorporate a large spring that responds to the vibrations of its strings to give maximum resonant effect and amplify/modify the tones generated by plucking, strumming, striking or otherwise vibrating these strings.

It is further known to secure a large spring to the frame of a guitar and suspending that spring vertically above the guitar strings over the outside top wall of the sound box and at a location in front of the bridge piece. A loop at the free end of this spring connects directly to two strings and vibrates with the strings to enhance the sound from the instrument. That spring device can be removed or disconnected if the original sound from that instrument is desired. Such a spring device has many disadvantages, however. It is unsightly; does not provide good attachment of spring-to-strings; and is difficult to install. Known (large) spring connections are quite cumbersome, and may also obstruct an area of the instrument where the user places his/her hand to pluck or otherwise activate the strings.

Relevant art to the present invention also includes the following disclosures, arranged chronologically: Sanns, Jr. U.S. Pat. No. 8,969,692, Aspri U.S. Pat. No. 8,222,503, LaMarra U.S. Pat. Nos. 7,838,752 and 7,488,878, Chiliacki U.S. Pat. No. 7,259,318, England U.S. Pat. No. 6,982,372 and Martin U.S. Pat. No. 6,646,191.

SUMMARY OF THE INVENTION

It is a feature of the present invention to provide an improved sound reverberator device, particularly, one that permanently connects to the interior of a guitar (or other stringed instrument) at or below the sound bridge to that instrument. This invention would be easy to install in the manufacture of new products but can, with some degree of care, be added to existing guitars and the like for greatly enhancing the tonality of sound emanating from that instrument and greatly prolonging the life of its bridge/soundboard.

From a broad aspect, the present invention provides sound resonance by connecting to the guitar's interior a plurality of specially shaped pre-load coils, each coil wrapping outwardly and then back inwardly about itself to form a section of resonation, with adjacent/nearby guitar strings having at least one resonator "set" comprised of a plurality of sections of spiraled resonator coils arranged IN SERIES and connected to the lower end, underside, beneath the sound bridge of the instrument.

These multiple sets of coiled wire sections are secured between the guitar face and backing. Each coiled set of resonators would connect to the underside of the guitar, nearest the sound bridge, using a resonator torsion arm. The SETS of coils can be commonly connected to a plurality of damping felts all controlled by a common, push button that partially extends through a lower base of the guitar exterior for damping these sound improvements when desired for a given song/application. Alternately, the damper can consist of a rotatable knob for varying the amount of damping desired for any given application of sound effect resonance damping (dampering or dampening).

BRIEF SUMMARY OF THE DRAWINGS

Further features, objectives and advantages of the present invention will be clearer with the following detailed description made with reference to the accompanying drawings and photographs in which.

DESCRIPTION OF PREFERRED EMBODIMENTS

Figure 1:
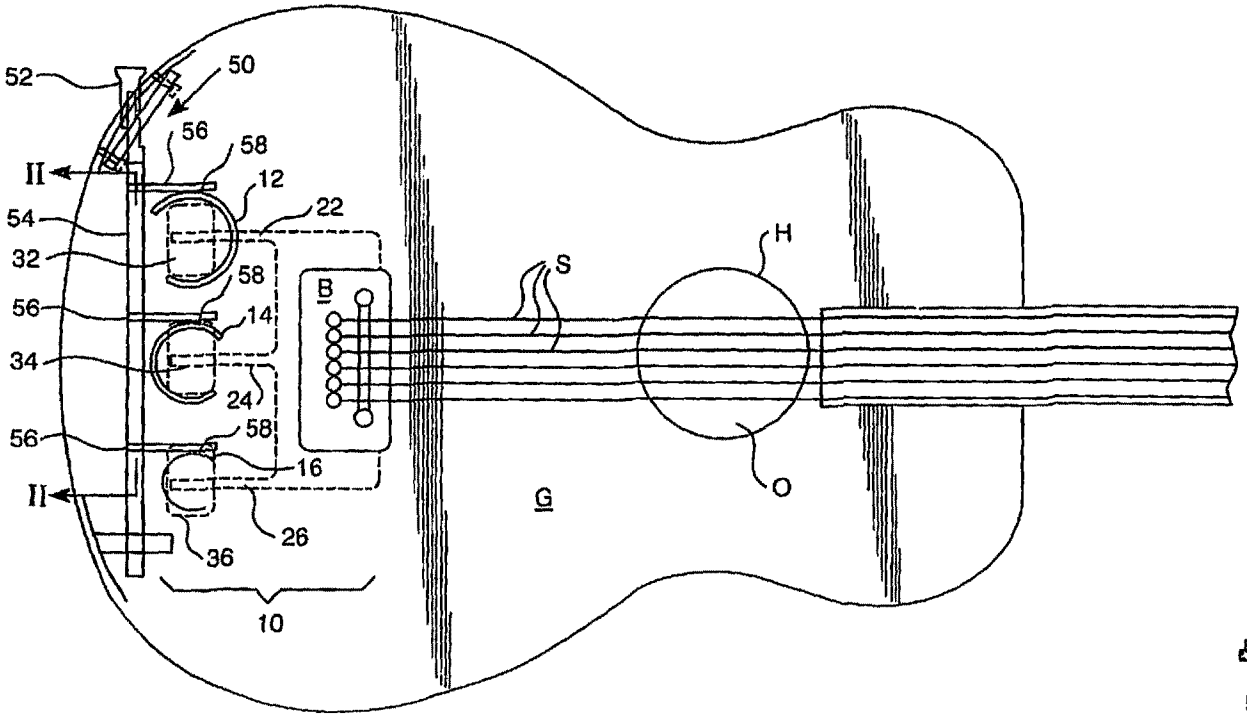
FIG. 1 is a top plan view of the lower end of an acoustic guitar showing three interior coiled spring connections and a lower body damper button per one embodiment of this invention.

From a broad aspect, the present invention provides sound resonance by connecting to the guitar's interior a harmoniously selected, plurality of specially shaped spring coils, each coil wrapping outwardly and then back inwardly about itself to form an accordion-like section of resonation, with adjacent/nearby guitar strings having at least one resonator "set" comprised of a plurality of sections of spiraled resonator coils arranged IN SERIES and connected to the lower end, underside, beneath the bridge of the instrument.

These multiple sets of coiled wire sections are secured between the guitar face and backing. Each coiled set of resonators would connect to the underside of the guitar, nearest the bridge, using a resonator torsion arm. The SETS of coils can be commonly connected to a plurality of damping felts all controlled by a common, mechanical push button or a rotational knob for damping these sound improvements when desired for a given song/application.

While the respective sets can be made in individual units and connected, in series, to one another, it is preferred that they instead be made as one continuous unit of outward then inward windings and unwindings of metal wire.

The first set of sections, made of a finer gauge of metal wire (about 0.009" to about 0.032" diameter) should connect to the B and high E strings of a standard six-string guitar. The second set of coiled resonator (stacked) sections, made from a thicker gauge of wire (about 0.016" to about 0.046" diameter) would be joined to the middle two strings, the D and G strings with a third, larger still set of stacked resonator coils (made from the largest of the three wire gauges employed hereby, about 0.026" to about 0.095" diameter) connecting to the last remaining strings, the low E and A strings of a standard 6-string acoustic.

In alternative embodiments, a plurality of coils may be joined to the bridge plate, through the torsion arm, for adjacent/nearby strings in different configurations than those set forth above. Furthermore, any given resonator coil may be varied in wire gauge (and/or diameter) in the same coil such that the wire thickness may change from thick to thin and then back to thick, etc. for the same resonator.

For 12 string guitars, for example, additional sets of resonators may be added. And for instruments with fewer than six strings, a banjo, violin, bass, etc., there may be acceptable reductions (or increases) in the number of resonators installed thereunder.

There will be some preferred materials of choice to make respective SETS of resonator coils but for now all three sets may be made from one common metal, in different thicknesses of wire product, specially coiled outwardly then intentionally inwardly, with the coil "wave frequency" (or pitch) varying, even within any given coil. Suitable wire materials for these reciprocating coil windings can be made in harmoniously matched sets, just as the surface strings of the instrument proper are in matched sets, made from stainless steel, medium carbon steels phosphorus bronze and/or brass. Other materials may be customizable based on cost of manufacture and/or desired degree of sound improvement sought.

Figure 2:
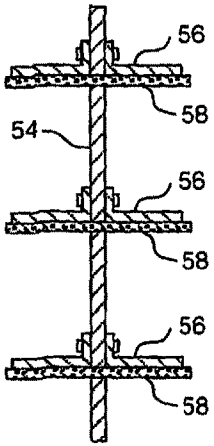
FIG. 2 is a side sectional view taken along lines II-II of FIG. 1.

Referring to FIGS. 1 and 2, there is shown a first embodiment of sound resonator device, generally 10, with a lower body, slider or button style damper, generally 50 secured to the insides of an acoustic, six-string (or "classical") guitar G. As shown, resonator device 10, is made from three subcomponent coils 12, 14 and 16, connected via their own respective torsion arms 22, 24 and 26 to an underside of one or more strings S of guitar G disposed rearward of its bridge B located rearward of an aperture, opening or hole H for the guitar's sound box.

Each sound resonator "set" may consist of a plurality of spiraling metal coils, with the guitar proper having one set per string (or adjacent strings) or possibly three sets in total for a six-stringed instrument. Each set is further secured at a rear end to its own respective support 32, 34 and 36 on a rear wall of the guitar body's inner housing and at a front or forward most end of the rear soundboard (or opposite wall O) to the face of guitar G in FIG. 1.

The three sets of resonators employed within guitar G are purposefully spaced from one another. They are NOT meant to contact each other in any manner. As mentioned earlier, it is ideal to incorporate such resonator sets in the NEW construction of a guitar. It is to be understood, however, that resonators may also be carefully inserted into an existing unit, albeit by labor intensive retrofitting.

With the sound resonator devices installed as shown, the tension applied onto the standard bridge B of guitar G will be lessened. As for the resonators, when a string S on guitar G is plucked, it imparts a vibration that will be transmitted to the sound box via the bridge piece B. With the invention, however, that same vibration will now be transferred, via its torsion arm to an involute coil set for that string (or strings) for a functional energy storage and retransmission. The coil set is thus set into vibration and that vibration gets transmitted back and forth and eventually into either the back soundboard or the front soundboard via a connecting rod, with some residual effects re-entering the bridge area as well. The added vibration areas provide a resonant sound and amplify, give volume, prolong and further modify the tones usually generated by the vibrated string of that instrument alone.

With the present invention, there is purposefully added a slider damper 50 for lessening the effects of resonant sound control, either for a whole song (i.e., its exterior button 52 could be pushed in (with detents) and/or held in a momentary sense) or for a given set of notes/lines of music. More particularly, damper 50 as seen in cross section at FIG. 2 includes a push rod 54 that connects to the slider button 52 exterior of the guitar body proper. That push rod 54 has a plurality of divider units, each such unit including a sidewall component 56 and a felt covered cushion 58 there against. It is understood that by activating the slider button 52, these felt cushions 58 will press against the adjacent involute coil sets and prevent them from adding resonance sound effects. In a more complex variation of slider configuration (not shown), each involute coil set could have its own, separate damper so that only certain of the coils could be "muted" while leaving the others open for resonance sounding.

Referring now to FIGS. 3 through 6, it should be noted that common elemental components between the various embodiments are commonly numbered, though in the next hundred series.

Figure 3:
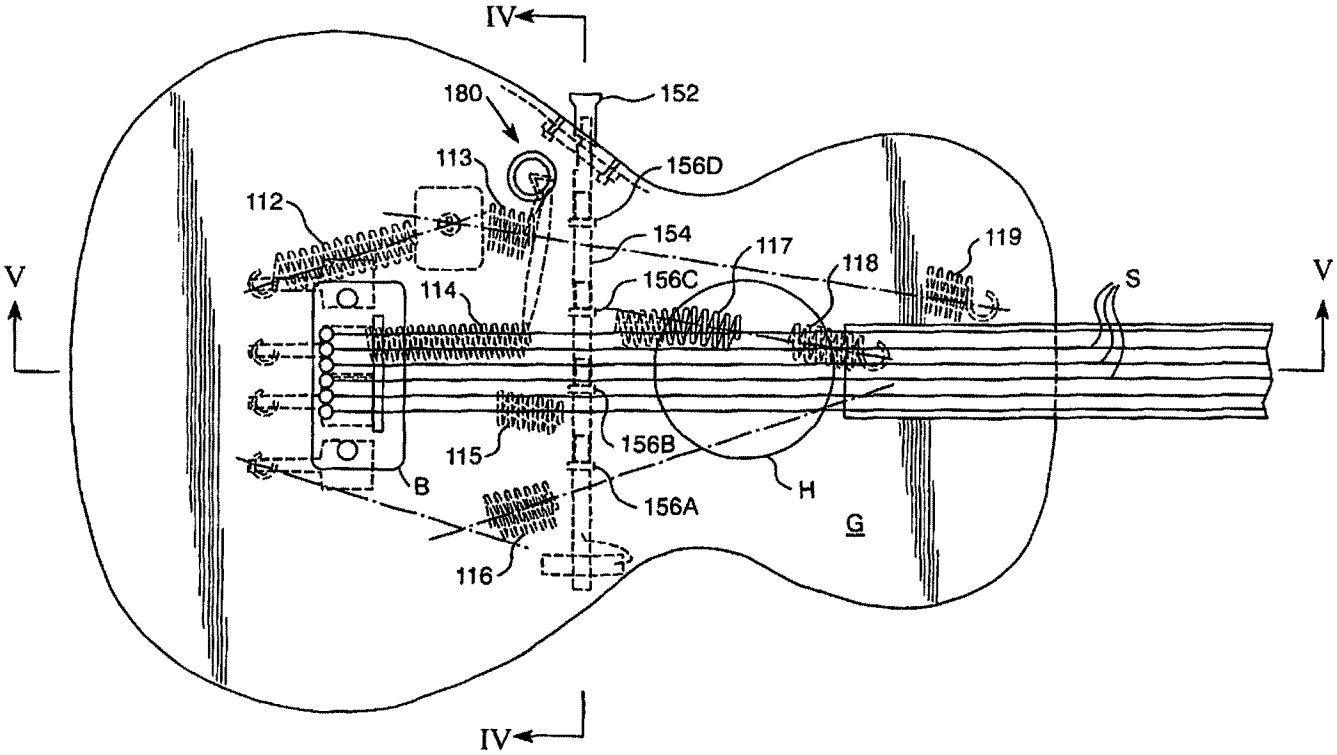
FIG. 3 is a top plan view of the lower end of a second acoustic guitar showing an alternative arrangement of interior coil connections with both a mid-body damper button and a graduated rotary damper in the guitar per two alternate embodiments.
Figure 5:
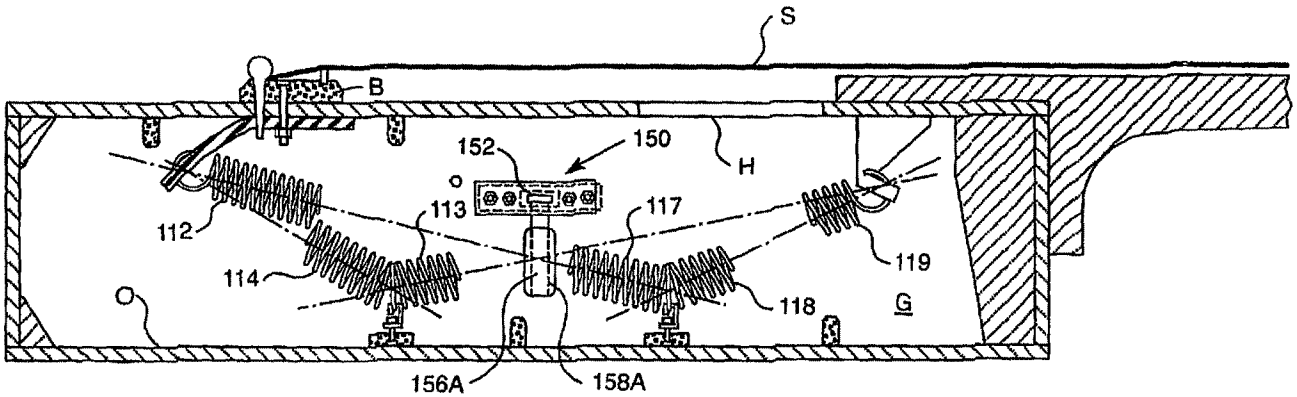
FIG. 5 is a side sectional view taken along lines V-V of FIG. 3.
Figure 6:
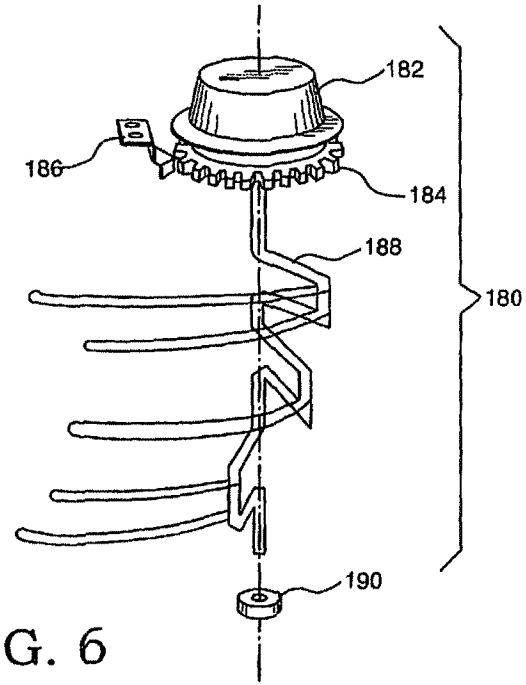
FIG. 6 is a perspective view of the detent, adjustable knob style damper shown to the left of the selector push button style damper in the guitar at FIG. 3.

FIGS. 3 and 5 show a guitar body G having inside a plurality of slightly involute coil sets 112, 113, 114, 115, 116, 117, 118 and 119 connected to various interior points of the instrument. While these are a cruder representation of resonator devices than the steeper involute coil sets of FIG. 1, they are included more so to show: (a) a different mounting point, mid-body of guitar G, for a slider type damper 150, with its own button 152, push rod 154 sidewalls 156A, B, C and D for felt pads or cushions 158A, B, C and D adjacent their respective coil units CU1, CU2, CU3 and CU4. Depending on the relative positioning of these slider-bar dampers, some of the coil units may be made to adjoin/surround/damper one or more of the coil sets 112-119 in this alternate embodiments.

Though it is understood that it would be duplicitous to have both damper systems in the same guitar unit, FIGS. 3 through 6 also illustrate a second variation of sound dampering means for use with the resonator devices of this invention. More particularly, towards a 12 o'clock position on the face of guitar G in FIG. 3, there is shown a second knob-based damper 180 which can be cranked clockwise or counter-clockwise to engage or disengage as desired. That second knob-type 180 (not seen in the cross-sectional view at FIG. 5) would have a top adjustment dial/knob 182, a detent gear 184, detent spring 186 and camshaft 188 that would allow for leverage to any angle location before terminating in a bottom pillow block 190. With this alternate system of dampering interspersed between coils of a resonator device, this system could allow for the specific dampering by tensioning high tensile fiber threads interwoven between the coils for even greater variability.

Figure 4:
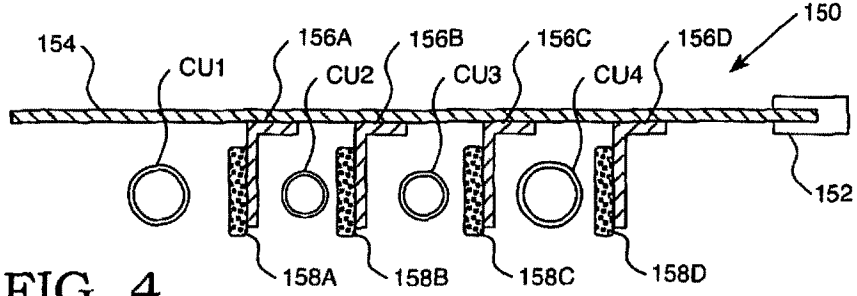
FIG. 4 is a side sectional view taken along lines IV-IV of FIG. 3.

With respect to the felt brackets of FIG. 4, it should be noted that when this damper is "at rest", there is a purposeful gap between the felt pad and coil immediately adjacent thereto. That gap can be determined according to harmonics of the overall unit (i.e. guitar) in any of a plurality of selected positions, be they gradient adjustable or infinitely adjustable since some of the damper pads will necessarily sit closer to their "assigned" coils than others in any given range making it possible to subdue resonant sounds sooner for some than for other(s).

For the felt damper of cross-sectional view, FIG. 5, it is noted that the coils depicted therein could find a convenient "conjunction" so as to share a common line of push rod travel there through. For more complex internals of resonator coils, the simpler slider may not be feasible. In those instances, it may be more prudent/practical to use a rotary damper alternative (FIG. 6) as the latter dampering system would be better suited for reaching most (if not all) of the various coils using just one, common mechanism.

Although, the resonator device of this invention is shown attached to a typical acoustic guitar, the device may also be used with other string instruments such as violins, mandolins, basses, etc.

Overall, this device was first purposed for the sound reproduction qualities that are (in and of themselves) very unique and long overdue. In its concept, however, it also serves a dual function of lessening torsion stresses on the guitar's bridge area, an infamously known headache for guitar manufacturers. That is where traditional bridge work often pulls away from and/or physically distorts the soundboard over an instrument's lifetime. The design of this invention greatly reduces the stresses on those areas for many musical instrument applications. It re-directs these traditionally unwanted stresses into a shock absorption-and-transfer mechanism that not only cancels out a large percentage of such torsional stresses on the bridge area, it also better utilizes previous wasted energies in achieving beneficial harmonics amplification and sound wave sustain/boosting efficiencies.

Overall, the two-fold intent behind this resonator system enhancement is to:

1. capture and utilize previous wasted energies coming from the vibrating strings and transfer that energy in varying harmonic time lags to the back sound board, back to the top soundboard, etc., etc., richly adding to the harmonic resonance of the frequencies being played on the surface, and 2. counter a substantial portion of the harmful moment-arm stresses acting upon the delicate bridge area of traditional instruments.

In doing so, this concept: helps produce a better free-floating soundboard; allows for more delicate construction characteristics of the front soundboard, which leads to greater sound amplification and clarity; while further expanding the frequency response on the initial vibrations themselves, where the top soundboard clarity and amplification are increased even when effects are dampened.

In addition to the foregoing main benefits, this invention achieves limitless organic 'textural' effects through this breakthrough marriage of innovative physics. Thanks to these layered/coiling resonator designs, it is possible to produce much more than just a single frequency sustain. An unlimited variety of tonal 'textures' can now be achieved simply by incorporating any number of complimentary combinations of such layered resonators, adjusting their coil shape, size and gauge. Then further harmonizing the number of such resonator sets that can be blended into each unit.

One of the basic principles of resonance states that a vibrating body of one frequency, i.e., the transmitter, will transfer its own vibrations through air (or through transmittal objects with a solid mass) to a nearby body with the same frequency characteristics, the receiver, causing that secondary receiving object (or objects) to vibrate in unison with the sender. This inventive design incorporates an involute form, offering an infinite number of receivers (and secondary transmitters) for such frequencies.

The acoustic behavior behind this design's special "layered" resonator construct has a unique and beneficial quality. The infinitely varying coil diameters and its unique pitch between coil waves (or its "spreads") result in a sound interaction not found with previous reverberation devices. These new resonator designs can mimic and reflect any frequency being created within the instrument including "bent" notes. In other words, the frequencies achievable herewith are not limited to what a routine single diameter coil winding is narrowly able to imitate.

The infinitely varying layers of these spiraled coil sets will also react with one another in a way where the wave energies can "bounce against one another" adding very slight but appreciable "chorus", "tremolo", "warmth" and other octave enhancing effects adding "textures", making the final result much more "interlaced with sound" than a simple monotone sustain. Each varying resonator, its gauge (or its varying gauge), and each stacked layer thereof then act as a separate and individually unique contributing "delay wave" in reaction to any of the given frequencies produced on the surface strings of said guitar. The cumulative effect adds "warmth" that is pleasantly unprecedented in an organic, acoustic instrument.

We claim:

1. A sound resonator device for a new or existing musical instrument that has a plurality of strings tensioned over a bridge piece connected to a soundboard, said soundboard having an interior face and an exterior face, said resonator device comprising:

(a) a torsion arm affixed to the interior face of the soundboard;

(b) a plurality of involute coil sets, each coil set forming a harmonic section that is capable of capturing a range of frequency energies when one or more of the plurality of strings are played for delayed redistribution to another area of the soundboard, said plurality of involute coil sets being connected at a first end to the torsion arm; and (c) a damper element for selectively engaging with one or more of the involute coil sets to dampen a resonation effect from said involute coil sets, said damper element having an activation button or knob that extends through and to an exterior of the musical instrument.

2. The resonator device of claim 1 wherein the plurality of involute coil sets includes two or more harmonic sections.

3. The resonator device of claim 1 wherein the damper element includes at least one felt pad for each involute coil set.

4. The resonator device of claim 1 wherein the damper element is a button that can be depressed to multiple levels of resonation effect dampening.

5. The resonator device of claim 4 wherein the button damper element extends through a mid-body section of the musical instrument.

6. The resonator device of claim 4 wherein the button damper element extends through a lower body section of the musical instrument.

7. The resonator device of claim 1 wherein the damper element is a knob that can be rotated to multiple levels of resonation effect dampening.

8. The resonator device of claim 1 wherein the musical instrument is an acoustic guitar.

9. The resonator device of claim 1 wherein the musical instrument is an instrument selected from the group consisting of a banjo, a violin, a bass, a cello, a mandolin, a fiddle and a ukulele.

10. A sound resonator device for connection to an acoustic guitar, said resonator device comprising:

(a) a torsion arm affixed to an interior face of the acoustic guitar;

(b) a plurality of involute coil sets, each coil set forming a harmonic section that is capable of capturing a range of frequency energies when one or more strings of the acoustic guitar are played for delayed redistribution, said plurality of involute coil sets being connected at a first end to the torsion arm; and (c) a push button damper element for selectively engaging with one or more of the involute coil sets to dampen a resonation effect from said involute coil sets, said damper element extending through and to an exterior of the acoustic guitar.

11. The resonator device of claim 10 wherein the damper element includes at least one felt pad for each involute coil set.

12. The resonator device of claim 10 wherein the damper element extends through a mid-body section of the acoustic guitar.

13. The resonator device of claim 10 wherein the damper element extends through a lower body section of the acoustic guitar.

14. The resonator device of claim 10 wherein the damper element can be slid in or out to effect multiple levels of resonation dampening.

15. A sound resonator device for connection to an acoustic guitar, said resonator device comprising:

(a) a torsion arm affixed to an interior face of the acoustic guitar;

(b) a plurality of involute coil sets, each coil set forming a harmonic section that is capable of capturing a range of frequency energies when one or more strings of the acoustic guitar are played for delayed redistribution, said plurality of involute coil sets being connected at a first end to the torsion arm; and (c) a rotatable knob damper element for selectively engaging with one or more of the involute coil sets to dampen a resonation effect from said involute coil sets, said damper element extending through and to an exterior of the acoustic guitar.

16. The resonator device of claim 15 wherein the damper element includes at least one felt pad for each involute coil set.

17. The resonator device of claim 10 wherein the damper element can be manually rotated to affect multiple levels of resonation dampening.

* * * * *